United States Patent [19]

Spies

[11] Patent Number: 4,798,501

[45] Date of Patent: Jan. 17, 1989

[54] FLEXIBLE ROCK ANCHOR

[75] Inventor: Klaus Spies, Aachen-Schmithof, Fed. Rep. of Germany

[73] Assignee: Rudolf Hausherr & Sohne GmbH & Co. KG, Sprockhovel, Fed. Rep. of Germany

[21] Appl. No.: 89,739

[22] Filed: Aug. 26, 1987

[30] Foreign Application Priority Data

Aug. 29, 1986 [DE] Fed. Rep. of Germany ..... 3629365

[51] Int. Cl.[4] ..... E21D 20/02; E21D 21/00

[52] U.S. Cl. ..... 405/260; 405/259; 411/383; 411/385

[58] Field of Search ..... 405/259, 260, 261, 244; 411/908, 907, 383, 385

[56] References Cited

U.S. PATENT DOCUMENTS

| | | | |
|---|---|---|---|
| 2,078,473 | 4/1937 | Truempey . | |
| 3,301,123 | 1/1967 | Worley | 405/259 X |
| 4,000,623 | 1/1977 | Meardi | 405/260 |
| 4,140,428 | 2/1979 | McLain et al. | 405/261 |
| 4,369,003 | 1/1983 | Brandstetter | 405/260 |
| 4,504,175 | 3/1985 | Zion | 405/260 |
| 4,650,373 | 3/1987 | Seegmiller | 405/259 X |
| 4,664,555 | 5/1987 | Herbst | 405/260 |

FOREIGN PATENT DOCUMENTS

| | | | |
|---|---|---|---|
| 2505684 | 8/1975 | Fed. Rep. of Germany | 405/260 |
| 2249214 | 5/1975 | France . | |
| 2496752 | 6/1982 | France . | |
| WO84/00048 | 1/1984 | PCT Int'l Appl. | 405/259 |
| 0641112 | 1/1979 | U.S.S.R. | 405/260 |
| 0929864 | 5/1982 | U.S.S.R. | 405/260 |
| 1604613 | 12/1981 | United Kingdom | 405/259 |

*Primary Examiner*—Dennis L. Taylor
*Attorney, Agent, or Firm*—Herbert Dubno

[57] ABSTRACT

The flexible earth anchor useful for reinforcing underground structures such as a traverse is insertable in a hole in the ground to a certain depth and is attachable with the walls of the hole at its end facing the deepest portion of the hole or along its entire length. Advantageously an adhesive means is used for the attachment. The anchor is constructed from a plurality of lamella in close contact with each other and slidable against each other. Advantageously the lamella are made from sheet metal in a continuous manufacturing process and are attached together by welding. They can be spread out at their inserted end in the hole to provide a better bond to the adhesive and held together by a ring. A sleeve can be provided at the chamber end which is attached by welding to the lamella and which can be used to rotate the earth anchor during the adhesion process.

12 Claims, 6 Drawing Sheets

FLEXIBLE ROCK ANCHOR

FIELD OF THE INVENTION

My present invention relates to a flexible rock anchor for rock strata and structures and, more particularly, to a rock anchor which is insertable in a hole bored in rock structures to a certain depth and is braced against the wall of the hole at its end facing the deepest portion of the hole or along its entire length, advantageously by an adhesive means in accordance with rock strata stabilization using bolting principles.

BACKGROUND OF THE INVENTION

Rock anchors using bolting principles are—according to their purpose—inserted into the rock in different lengths and have different diameters. They bear different load forces in underground structures by insertion in the rock surrounding a mine shaft or gallery to increase the load bearing strength of the rock.

The increase in load bearing strength of the rock mantel surrounding the excavated gallery or tunnel can result because the layered, slightly stable rock layers are "suspended" or fixed in compacted layers located over them.

Stabilization also results from the frictional locking or contact between the neighboring layers and thus the rigidity of the anchored total structure is increased by the load force of the anchor (compression or by load forces built up by rock movement) so that the rock motion is opposed directly by the strong resistance of the rock anchor or the anchor—comparable to a concrete reinforcement—increases the binding strength of the rock.

To fulfill this function the rock anchor can be equipped usually with special devices at its end located in the deepest portion of the hole in the rock. These special devices provide an adhesive or binding action in the ground by spreading or attaching to the hole wall.

Advantageously a multicomponent adhesive (e.g. an epoxy resin) can be provided at the hole wall. In one case the rock anchor is provided with adhesive along its entire length in the hole. At its free end projecting from the hole, the rock anchor is provided with a screw and nut or with a screw head mounted on the anchor by which a supporting member bearing the anchoring force is formed by an anchoring plate pressed against the free rock surface at which the rock-bolt hole opens.

The anchor structure is mostly used in tunnel structures to keep the rock around the subterranean chamber rigid prior to building the final support structure (chiefly a single or multi-layered lining concrete) and to increase the self supporting properties of the surrounding rock after the final structure is constructed. These functions can be assisted in the tunnel structure by selecting an optimal cross section for the effectiveness of the anchoring structure.

In subterranean excavating processes, such as mining, e.g. in local supporting pillar mining, in which only a portion of the minerals are mined and columns or pillars for support of the overlying layers remain in the deposit between the chambers originating from the mining, the cross section of the gallery chiefly results from the character of the mined bed alone so that the function of the anchoring structure in this case is not assisted by an optimized cross sectional shape. The anchor structure has been extraordinarily effective in bituminous coal mining in the United States, Canada, Australia and South Africa.

In the mining process in which columns of the mined minerals remain between the mine structure for support of the overlying rock layers in the deposit, the rock anchor is used to absorb only comparatively small rock motions which result from the elastic back compression of the rock surrounding the chamber and from the plastic motions which are ascribed to the compression distribution surrounding the rock chamber. With the complete mining of the deposit which is the predominate mining method in European coal mining considerably larger rock motions arise which are a result of the substantially stronger disturbance of rock surrounding the chamber. In long-wall mining, which is in fact the predominate mining process, mining must be effected in zones in which as a result of the additional pressure extraordinarily high forces occur. The additional pressure amounts in these zones chiefly to a multiplication or amplification of the superposition pressure.

These pressure manifestations which complicate tunnel building and local supporting pillar mining are the basis for using the anchor structure in European and particularly German coal mining only under particularly good neighboring ground conditions, i.e. with comparatively good stability or rigidity of the surrounding ground. There have also been many attempts to use flexible rock anchors to correspondingly improve the situation when there are higher rock motions as a result of complete mining of the deposit. For years, however, no breakthrough or other success has occurred. The use of the exceptional rock anchor in German coal mining has thus been comparatively limited as has been mentioned previously.

The rock anchor structure most widely used in coal mining (both in local supporting pillar mining and with complete mining of the deposit) comprises an anchoring rod or bolt whose surface is shaped or profiled to improve the action of the adhesive. Since the anchor is exposed to the rock motion only a material can be used which has a sufficient stress resistance or flexibility up to its elastic limit for breaking. With previously used anchor cross sections the highest allowed load is limited to a comparatively small value.

On account of the considerably larger rock motions in complete mining of the deposit as opposed to local supporting pillar mining, rock anchors are used which comprise materials with substantially higher elasticity. Apart from the fact that with these anchors the highest allowed load is reduced a considerable amount by comparison with the previously used anchor cross sections, these anchors are too expensive because of excessive material cost.

Attempts have been made to use rock anchors with two diameters in which the larger diameter body is reduced by a drawing die. This gives a certain flexibility under load. Apart from the fact that these anchors are much more expensive than the standard anchor the underground trials or attempted uses have led up to now to no satisfactory results.

It has been proposed to use elongated reinforced concrete bodies as anchors to permit higher supporting force to be developed with the previously used hole diameter as a result of the use of materials of higher strength. These anchors are provided with a flexible element which works according to the friction principle (analogous to the known friction prop). They have the advantage in contrast to all other structures used in coal mining that the anchor rods are flexible and can bend around corners. This kind of insertion is particularly important in narrow curved chambers which should be safely secured with anchors whose length exceeds the dimensions of the chamber. Furthermore they provide considerable technical and economical advantages in gallery digging or tunnel construction because the anchor can be inserted above the tunnel or gallery digging machine and the idle time is usually considerably reduced. That idle time is presently almost 50% of the available running time of the machine.

OBJECTS OF THE INVENTION

It is an object of my invention to provide an improved rock anchor providing a more stable underground structure in tunneling and mining operations.

It is also an object of my invention to provide an improved rock anchor which is flexible thus widening the range of applications in underground construction yet has improved supporting properties for the rock surrounding the underground structures involved.

It is another object of my invention to provide an improved flexible rock anchor, especially for use in coal mining, providing a more stable underground structure which in spite of higher technical requirements can be made at comparatively lower cost.

SUMMARY OF THE INVENTION

These objects and others which will become more readily apparent hereinafter are attained in accordance with my invention in a flexible rock anchor which is insertable in a hole in the rock to a certain depth and is attachable to the walls of the hole at its end facing the deepest portion of the hole or along its entire length, advantageously by an adhesive.

According to my invention the anchor is constructed from a plurality of lamella in close contact with each other and slidable against each other.

The lamella can be of different widths and the width and/or the thickness of the lamella can be such that an optimal circular-section outer surface is approached or approximated. The lateral edges of the lamella can be advantageously inclined at a plurality of different angles to the plane of the lamella to approach as closely as possible the optimum circular outer surface by a polygon approximation or fit. The lamella can be cut in a continuous manufacturing process from a plurality of sheet metal strips and subsequently cut to length.

The lamella can be spread in a pinetree like shape at the end of the anchor located in the hole. The spread portion of the lamella can be provided with a shape designed to increase the adhering surface for the adhesive and to improve the formlocking connection between the anchor and the adhesive. The lamella can be held together in the vicinity of a pinetree like spread portion by a ring. The lamella can be attached to each other in the vicinity of the pinetree like spread portion by a weld joint, especially by spot welding.

In other examples of the flexible rock anchor in case of a complete cementing of the anchor the lamella are covered by a plastic tubing.

The lamella can be formed with a thickness/width relationship such that the lamella are rotatable in the plane of least resistance with load forces which are effective in a direction parallel to the laminar plane.

The lamella can be composed of a high strength heat treatable material fabricated and heat treated in a continuous manufacturing process.

A sleeve can be provided on the chamber end of the lamella. A head can be located on the sleeve which allows the sleeve to rotate the anchor in an easy way with an outside tool. The sleeve is connected by welding with the lamella. The lamella are connected with each other at the chamber end by welding, especially spot welding. The heat produced by the welding can be used to give the chamber end of the lamella a cylindrical shape by engaging a tool on the heated stack from the exterior. The sleeve can be attached (e.g. by swaging) by an exteriorly engaging tool on the lamella. The sleeve can be widened slightly in one region and a formlocking connection can be made between the lamella and the sleeve by a wedge. The sleeve and the lamella are widened slightly in a region by a tool and the space resulting is filled by the adhesive or by a fused metal.

A servoring and a tension ring are positioned on the sleeve and are axially slidable into each other and on the sleeve. The friction between the servoring and the tension ring can be comparatively small in comparison to the friction between the servoring and the sleeve.

Brief Description of the Drawing

The above and other objects, features and advantages of my invention will become more readily apparent from the following description, reference being made to the accompanying highly diagrammatic drawing in which.

SPECIFIC DESCRIPTION

Figure 1:
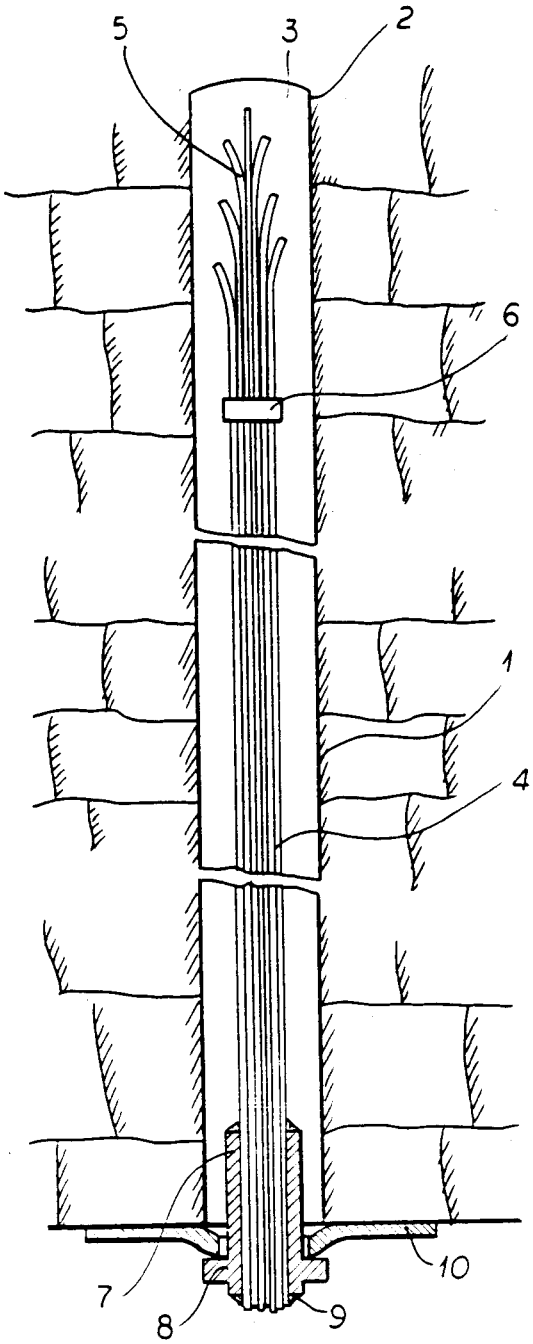
FIG. 1 is a longitudinal cross sectional view through an anchor bore with a laminar anchor according to my invention located in it.

In FIG. 1 an rock anchor is illustrated in a hole 1. It is cemented to the hole wall only in the vicinity of the deepest portion of the hole 1. The adhesive 3 is prepared from components in a known way which are contained in a cartridge in a hollow space separated from each other. The cartridge is pushed into the deepest portion of the hole and is destroyed by the subsequently insertion of the anchor. Thus the mixing occurs either by rotation of the anchor or—in a more recent development—automatically as both adhesive components penetrate into the other.

The anchor alone comprise a plurality of lamella 4 positioned next to each other which are advantageously made from endless strips of different width and/or different thickness. A shape for the lamellar cross section is chosen so that the cross section of the lamellar anchor is as close as possible to circular. The difference between the diameter of this circular surface and the hole diameter is determined by the size of the circular space which is necessary for the adhesive.

The different length lamella spread out pinetree like to form a spread portion 5 at the end of the rock anchor located at the deepest point of the hole to provide the largest possible adhering surface for the adhesive, to cement each individual lamella and to attain a particularly good mixing of the components of the adhesive by rotation of the lamellar anchor. Below the pinetree like spread out portion 5 the lamella are attached with each other engaged according to shape by a ring 6 which is pressed to the lamella or allows a certain relative motion of the individual lamella.

As shown, FIG. 1 a sleeve 7 is pushed over the free ends of the lamella at the gallery or chamber end of the lamellar anchor which can project with its one end into the hole and carries a component 8—advantageously a screw head—at the free chamber end which allows the transmission of a torque by a tool engaged from the outside to improve the mixing process of the adhesive components. The sleeve 7 can be heat sealed with the lamella 4. It can be press fitted or attached in different other ways to the anchor. In the example of FIG. 1 the attachment occurs by weld seam 9. It can however also be a spot or projection weld. The collar of the component 8 of the lamellar anchor supports itself on an anchor plate 10 which is bulged out in a known way to allow a variety of angles between the anchor and the anchor plate.

Figure 2:
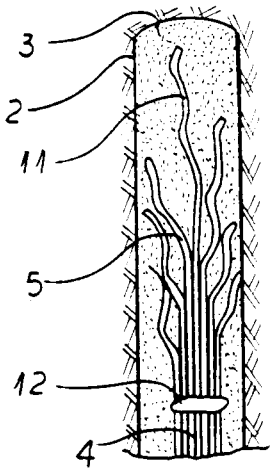
FIG. 2 is a broken-away longitudinal cross sectional view through the pinetree like spread portion of the laminar anchor of FIG. 1 in the anchor bore with a pressed section.

In FIG. 2 a structural variation of the pinetree like spread out portion 5 at the end of the anchor is located at the deepest portion of the anchor in which the individual lamella are shaped mechanically (e.g. in a press) to provide the adhesive with a larger surface and to improve the adherence during pulling. In the manufacturing process the mechanical shaping is associated with the cutting to length or cross cutting process in the assembly line production of the lamella from strips.

The attachment of the individually anchored lamella is effected by electrical spot welds 12.

Figure 3:
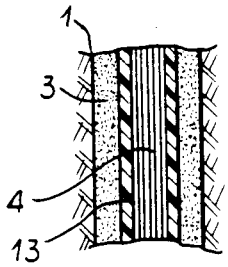
FIG. 3 is a longitudinal cross sectional view of an anchoring shaft covered with a plastic tube adhesive bonded over its full length in the bore.

Anchors are frequently provided as "completely cemented anchors", i.e. before the anchor is inserted into the hole several adhesive cartridges are put into the hole so that the hollow space between the anchor and the hole wall along the entire anchor length is completely filled with adhesive. An essential advantage of the flexible rock anchor is seen in its response to shearing or pushing forces. To be able to take a high pushing or shear force without damage or loss the anchor according to FIG. 3 is covered with a plastic coating or tubing 13. Then the individual anchor lamella can move axially together or separately in spite of complete cementing with the adhesive.

Figure 4:
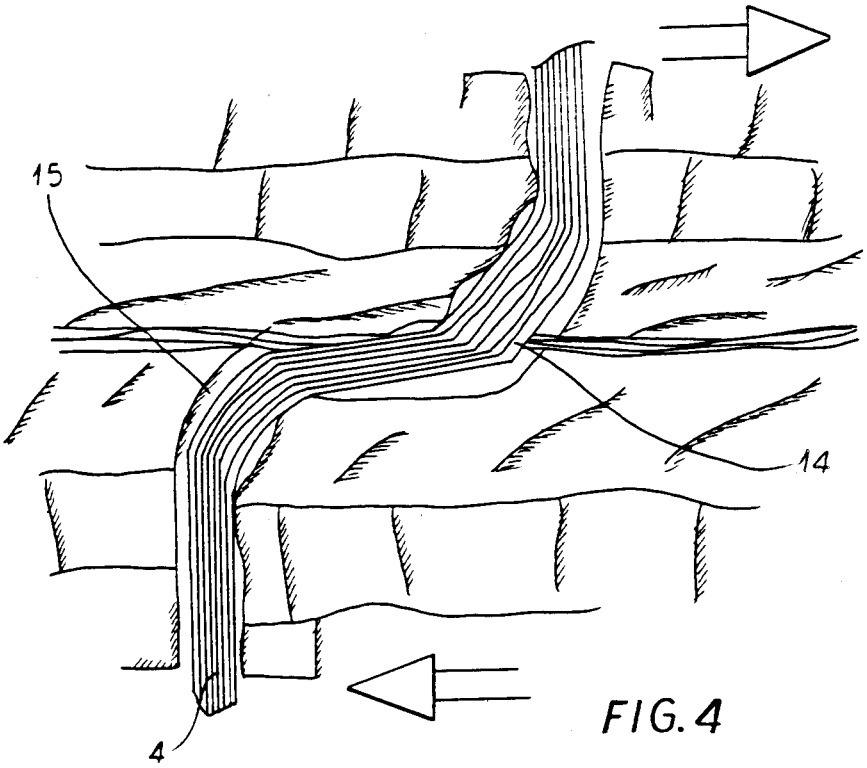
FIG. 4 is a cross sectional view through a laminar anchor according to my invention being acted on by a shearing force in the rock.

In FIG. 4 an rock anchor which comes under a high pressure is shown under a load which frequently occurs in chamber work. With the forces acting the strength of the packed layers surrounding the gallery chamber is exceeded at many places so that the tension operates at the fractures and faults by the relative motion of adjacent surfaces. With this relative motion the inserted anchor between the individual strata is subjected to a particularly high load. It must follow the comparatively large displacement of the rock strata without being destroyed. As a result of the lamellar structure the rock anchor in this position can take a comparatively large thrusting motion without a large stretching of the individual lamella which could lead to tearing and thus to breaking. The lamella form the "outer fibers" of the bend at location 14 and the "inner fibers" at location 15. Since the individual lamella can slide against each other axially in contrast to the one piece rock anchor no excessive tension occurs in the individual structural elements during the formation of this S-shape bend.

The lamellar anchor behaves similarly to what has been illustrated in FIG. 4 with thrusting forces acting perpendicularly to the lamellar plane, i.e. with thrusting forces which act in the direction of the lamellar plane. The individual lamella give out or weaken on application of forces in the lamellar plane according to the basic principles of mechanics in the plane of least resistance moment so that it twists in the hole and behaves according to FIG. 4. That means that the advantages of the laminar anchor are completely effective in all possible directions of application of the applied forces. No structural form of an rock anchor known or used up to now can match the thrust load capacity of the lamellar anchor according to my invention.

Figure 5:
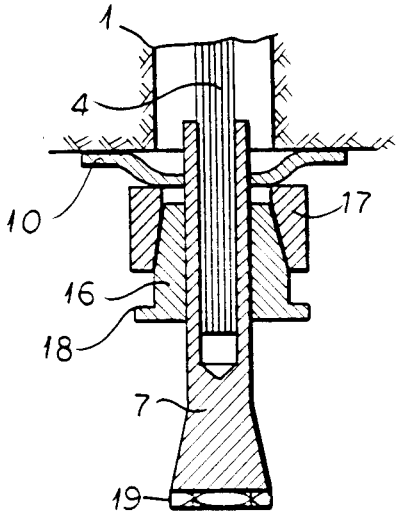
FIG. 5 is a longitudinal cross sectional view of a sleeve with a flexible elastic element mounted on the chamber end of the laminar anchor according to my invention.

Another flexible lamellar anchor is illustrated in FIG. 5. The flexibility of the anchor structure is extraordinarily advantageous in gallery work where comparatively large rock motions occur in the region of the chamber or gallery. I can also use an anchor of higher quality material which is available chiefly with reduced breaking tension. The carrying capacity of the anchor is substantially raised by the higher quality material. The disadvantage of the reduced tension is more than compensated by the flexibility.

In the embodiment according to FIG. 5 the sleeve 7 pushed over the chamber end lamella is pressed on with a higher pressing force so that the adherence of the sleeve to the lamella is larger than the breaking force of the anchor. Machines with which sleeves can be swaged on rope or bar and/or plate bundles with a high adherence are known.

A conical servoring 16 which is inserted in a tension ring 17 under load is located on the outer surface of the sleeve 7. The contacting surfaces are formed so that the friction between the rings 16 and 17 is small and the friction between the ring 16 and the surface of the sleeve 7 is contrastingly larger. On loading accordingly next the ring 16 enters the ring 17 up to the stop 18. Thus the ring 17 is under pressure so that a high standard force and thus a high frictional force arises. The frictional events occurring between the surface of the sleeve 7 and the servoring 16 can be a mixture of friction, surface deformation and jamming since the displacement is performed only once during the life of the anchor.

The pressed on sleeve 7 carries a screw head 19 on its free end to generate the rotary motion required for mixing adhesive components upon its engagement by a tool from the outside.

Figure 6:
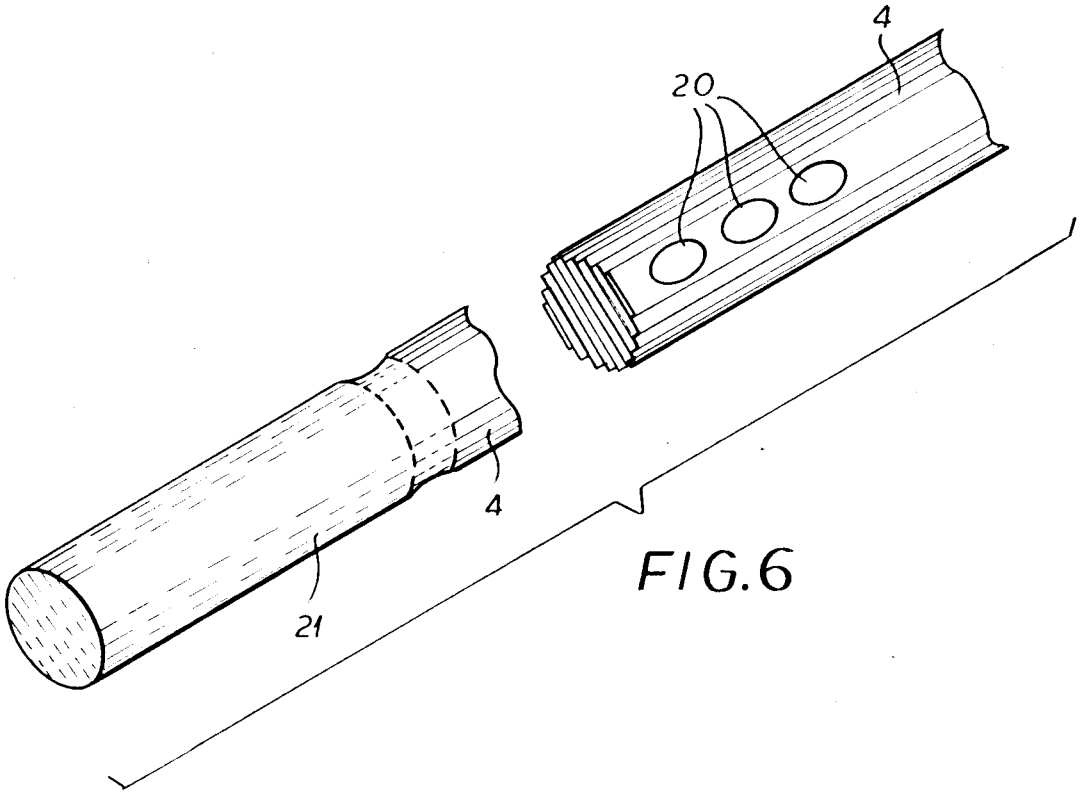
FIG. 6 is a perspective broken-way view of a modification with which one end of the laminar rock anchor according to my invention could be transformed to a cylindrical rod by exterior pressing forces.

In FIG. 6 a particularly well made and economical structural form for the end of the lamellar anchor projecting into the chamber is illustrated. The lamella 4 are attached by an electrical point weld 20 rigidly with each other. Subsequently using the considerable heat originating from the spot welding a cylindrical shape 21 is made by engaging a press tool exteriorly at the place where the not-illustrated servoring 16 and tension ring 17 of FIG. 6 are located. By these desirable structural forms a particularly economical lamellar anchor can be fabricated.

Figure 7:
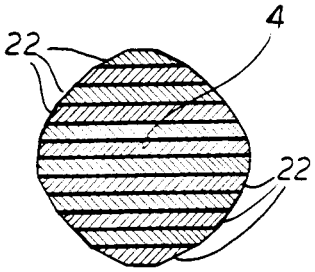
FIG. 7 is a cross sectional view through an individual rock anchor showing the lamella.

FIG. 7 shows a cross section through the packet of the lamella 4. The individual lamella which advantageously are cut in a continuous manufacturing process from strips of sheet metal can have a rectangular cross section or—as illustrated in FIG. 7—a trapezoidal cross section whose inclined outer edges 22 more closely approximate the desired circular arcs which would make up a perfectly circular rock anchor cross section. For the individual positions the outer edges 22 can be cut at different angles in the manufacturing process as described. In this way the cross section carried by the rock anchor is particularly large. It has practically the same cross section as comparable anchoring rods but the extraordinarily important above described advantages of improved load properties cause the anchor to handle load forces and motions better because of its lamellar structure.

Figure 8:
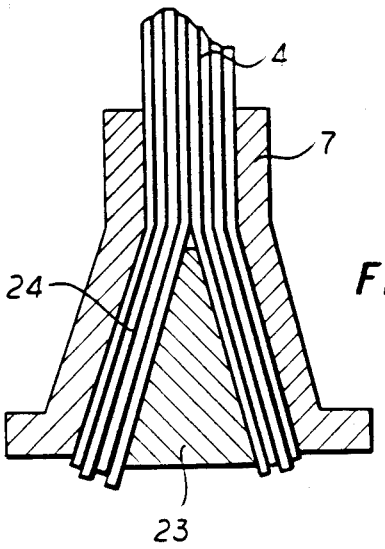
FIG. 8 is a broken-away longitudinal cross sectional view showing the fixing of the lamella in place in the chamber end sleeve by a wedge.

In FIG. 8 a form of attachment between the sleeve 7 located at the chamber end of the lamellar anchor and the lamellar pack 4 is illustrated in which the lamellar packet spreads and a wedge 23 is driven in the sleeve 7. The sleeve 7 is thus advantageously widened in the region 24 so that a satisfactory fit between the lamellar packet 4 and the jacket 7 results.

Figure 9:
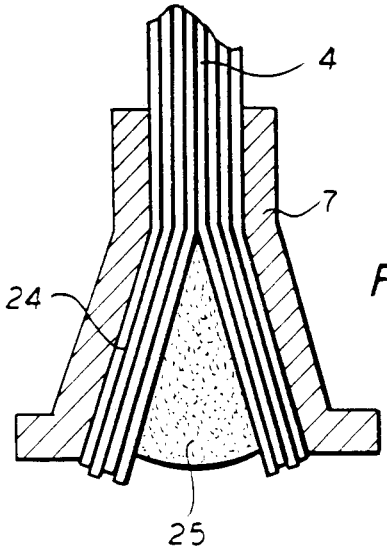
FIG. 9 is a broken-away longitudinal cross sectional view showing an alternative for attachment of the lamella in the chamber end sleeve.

In the embodiment according to FIG. 9 the same fit can be attained. The lamellar packet 4 and the sleeve 7 are widened in the region 24 by an not-illustrated prong tool and the resulting space subsequently filled by adhesive or infused metal 25.

Figure 10:
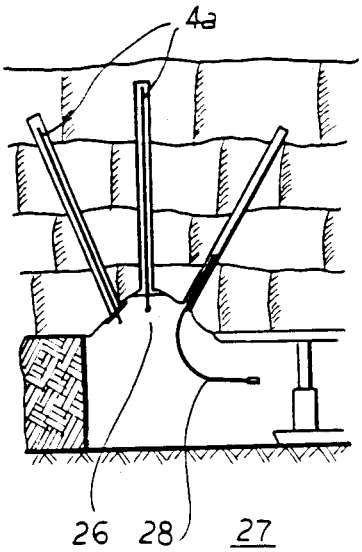
FIG. 10 is a cross sectional view showing the introduction of a flexible laminar anchor in holes in a traverse whose length is larger than the traverse opening.

In FIG. 10 a particularly difficult situation in constructing a traverse is shown in which the traverse overhead 26 is extended from the cap peak of the structure 27. Particularly with reduced strength bed rock it is felt that because of safety requirements rock anchors **4*a* should be inserted whose length is greater than the traverse opening. This can be done in a particularly simple way with the lamellar anchor which can be bent as it is inserted in the rock anchor bore as is indicated at location 28**.

Figure 11:
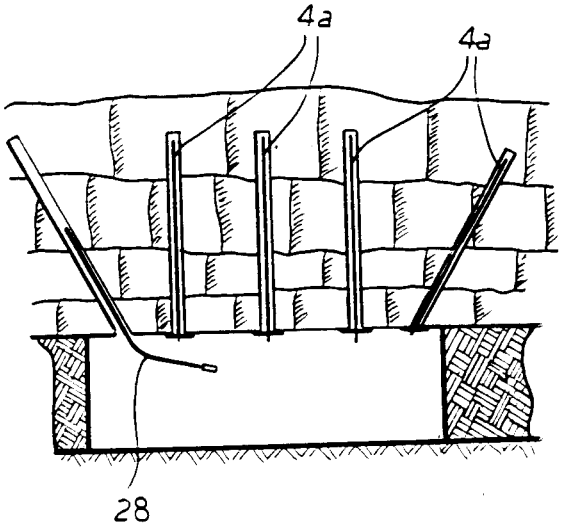
FIG. 11 is a cross sectional view showing the insertion of anchors in a ceiling or roof of a chamber or gallery.

From FIG. 11 it can be seen that the lamellar anchor **4*a* can be put in a ceiling or roof by the bent insertion as shown at location 28** even when the length of the anchor is larger than the chamber size would otherwise allow.

Figure 12:
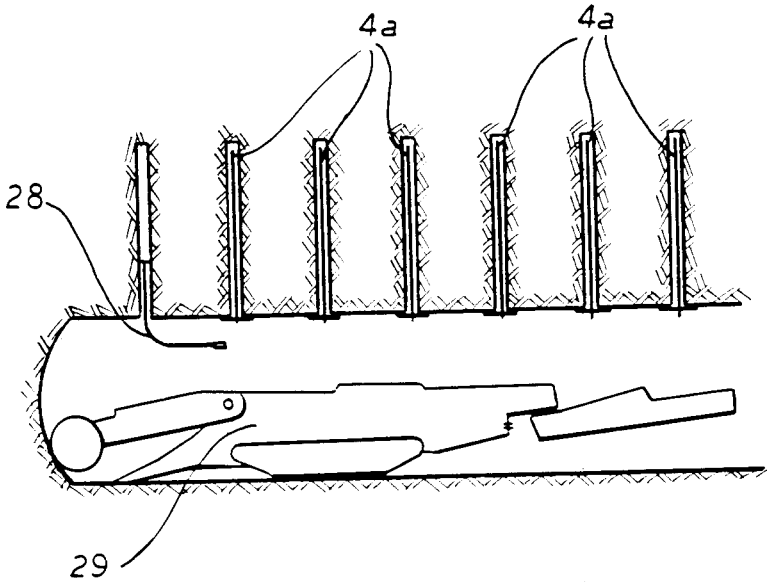
FIG. 12 is a cross sectional view with a lamelear anchor according to my invention above an excavating machine.

The rock anchor structure according to FIG. 12 is particularly advantageous in tunnel and gallery excavation. Here it is possible to insert the anchor structure above the tunnel and gallery excavating machine or excavator 29 by the bent insertion 28 of the flexible lamellar anchor **4*a* by a suitable auxiliary unit which is not shown in FIG. 12** without the excavating machine—as up to now was necessary—being idle. Since the time for insertion of the structures of all the mechanical gallery excavating operations is often larger than the excavating time, the use of lamellar anchors can double or further increase the excavating speed in the chamber.

I claim:

1. A flexible rock anchor which is insertable in a bore in the ground to a certain depth and is attachable to the walls of said bore at its end facing the deepest portion of said bore by an adhesive means, comprising:

a plurality of lamella cut in a continuous manufacturing process from a plurality of sheet metal strips in close contact with each other and slidable against each other, said width and said thickness of said lamella and the inclined lateral edges of said lamella being such that an optimum circular outer surface is approached, said lamella having a spread portion at the end of said anchor located in said bore shaped to increase the adhering surface for said adhesive and improve the formlocking connection between said anchor and said adhesive;

a ring provided around said lamella adjacent said spread portion to hold together said lamella; and a sleeve connected by welding with said lamella positioned on the chamber end of said lamella having a head which allows said sleeve to rotate said anchor in an easy way with an outside tool, the heat being produced by said welding being used to give said chamber end of said lamella a cylindrical shape by engaging a tool thereon from the exterior.

2. A flexible rock anchor insertable in a bore having an open end at a surface of the ground and attachable to walls of said bore at least at a portion thereof remote from the open end by an adhesive material, comprising:

an elongated stack having an axis and a free end located at said portion of the bore, said stack consisting of a plurality of elongated lamella of rectangular cross section and different widths, each lamella of said plurality having an individual thickness substantially less than a width thereof and being cut to individual length, each lamella being in contact with an axially slidable against other lamellae of the stack said stack being rotatable about said axis in said bore;

means for connecting said plurality of lamella in said stack while allowing each of said plurality of lamella be slidable against one another; and a sleeve partially inserted in the open end of and spaced from said portion of said bore, said sleeve projecting outwardly beyond said open said sleeve being connected with an end of said stack opposite said free end and being rotatable about said axis with said stack to provide a formlocking connection between said stack and the adhesive material at least at said portion of said bore.

3. The flexible rock anchor defined in claim 2 wherein each of said plurality of lamella has an end inclined at an individual angle toward a wall of said bore at said deepest portion of the bore so that said lamellae collectively form a pinetree-shaped structure at said free end.

4. The flexible rock anchor defined in claim 2 wherein said stack has a generally circular cross section.

5. The flexible rock anchor defined in claim 2, wherein said means for connecting said plurality of lamella is a ring located in a vicinity of said free end.

6. The flexible rock anchor defined in claim 2 wherein said sleeve and said end of the stack opposite said free end are welded together.

7. The flexible rock anchor defined in claim 2, further comprising a chamber formed in said sleeve in which said plurality of lamella are inserted.

8. The flexible rock anchor defined in claim 6 wherein said end of the stack projects beyond said chamber and engages a tool from the exterior of said bore.

9. The flexible rock anchor defined in claim 6 wherein said sleeve has an end inserted into said bore which is narrower than an opposite end of said sleeve.

10. The flexible rock anchor defined in claim 9 wherein said sleeve has a wedge located between said open end of said bore and said opposite end of said sleeve.

11. The flexible rock anchor defined in claim 9, wherein said end of said stack is spread in said opposite end of the sleeve and a space resulting from spread of the stack is filled by the adhesive.

12. In a flexible rock anchor which is insertable in a bore in a ground structure and is attached at a portion of the bore remote from an open end of the bore by an adhesive material, the improvement wherein said anchor is formed from a multiplicity of metal strips formed into a stack and constituting respective lamellae, said lamellae having thicknesses less than the respective widths and different widths so that said stack generally has a circular cross section, the lamellae of the stack having free ends within said bore which are inclined away from one another, the lamellae being slidable against one another in axial direction and being rectangular in cross section and lying flat against one another.

* * * * *